United States Patent [19]

Pupp et al.

[11] Patent Number: 4,671,452

[45] Date of Patent: Jun. 9, 1987

[54] FLUID PACK WITH HANDLE

[75] Inventors: Herwig Pupp, Lund; Franz Soukup, Malmo, both of Sweden; Wilhelm Reil, Bensheim, Fed. Rep. of Germany

[73] Assignee: Tetra Pak Developpement S.A., Pully, Switzerland

[21] Appl. No.: 787,840

[22] Filed: Oct. 16, 1985

[30] Foreign Application Priority Data

Oct. 27, 1984 [DE] Fed. Rep. of Germany ..... 3439492

[51] Int. Cl.[4] ..... B65D 5/46

[52] U.S. Cl. ..... 229/52 B; 220/94 A; 222/465.1; 229/7 R

[58] Field of Search ..... 229/7 R, 52 B, 17 G, 229/3.1; 220/94 A; 16/110 R; 222/465 R

[56] References Cited

U.S. PATENT DOCUMENTS

| | | | |
|---|---|---|---|
| D. 160,516 | 10/1950 | Marsh | 222/465 R |
| 2,377,358 | 6/1945 | Moore | 229/3.1 |
| 2,710,135 | 6/1955 | Gaylord | 229/52 B |
| 2,742,218 | 4/1956 | Sullivan | 229/52 B |
| 3,003,678 | 10/1961 | Chase | 229/52 B |
| 3,176,879 | 4/1965 | Mojonnier | 222/465 R |
| 3,535,714 | 10/1970 | Bjork | 229/52 B |
| 3,924,797 | 12/1975 | Furbeck | 229/17 G |
| 3,998,378 | 12/1976 | Vetten | 229/3.1 |
| 4,327,861 | 5/1982 | Thompson | 229/52 B |
| 4,526,314 | 7/1985 | Reil | 229/3.1 |

FOREIGN PATENT DOCUMENTS

| | | | |
|---|---|---|---|
| 112812 | 1/1969 | Denmark | 229/52 B |
| 1335969 | 7/1963 | France | 229/7 R |
| 6608668 | 12/1967 | Netherlands | 222/465 R |
| 951341 | 3/1964 | United Kingdom | 229/3.1 |

*Primary Examiner*—William Price
*Assistant Examiner*—Gary E. Elkins
*Attorney, Agent, or Firm*—Biebel, French & Nauman

[57] ABSTRACT

A pack for containing materials which are capable of flow includes a tube formed by a longitudinal sealing seam, along with a bottom and a cover closing the tube ends. The cover is formed from thermoplastic material without a carrier material, is injected on the tube, and has a pouring spout. The tube comprises cardboard which is coated with thermoplastic material on one side. The bottom is quadrangular, formed from the folded-over tube of the pack of a fold-type closure. The cover and the cross-section of the pack, at least in the region of the cover, are round. To improve such a pack with a handle so that the final consumer enjoys improved handleability and transportability, the invention provides that a portion of the tube wall, which adjoins the periphery of the cover, is folded onto itself, forming a handle, and is joined to provide a double-wall surface portion in which a gripping opening is provided. The cover is extended over the upper edge of the double-wall surface portion with the gripping opening to provide a stiffening web.

9 Claims, 11 Drawing Figures

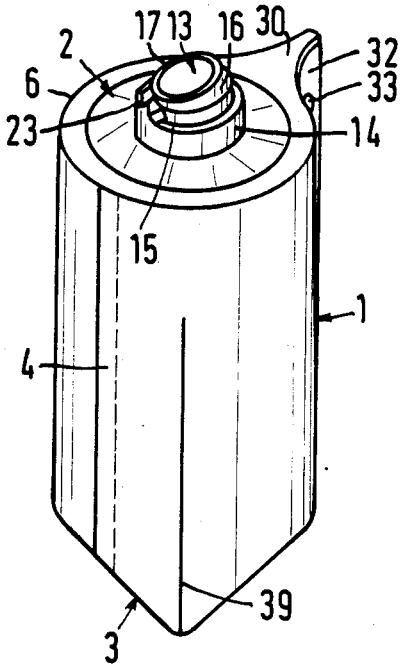
Fig.1
Fig.2
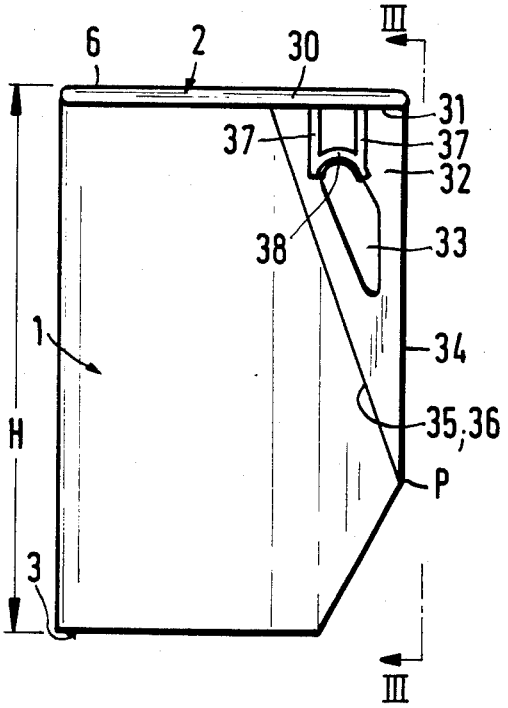
Fig.3
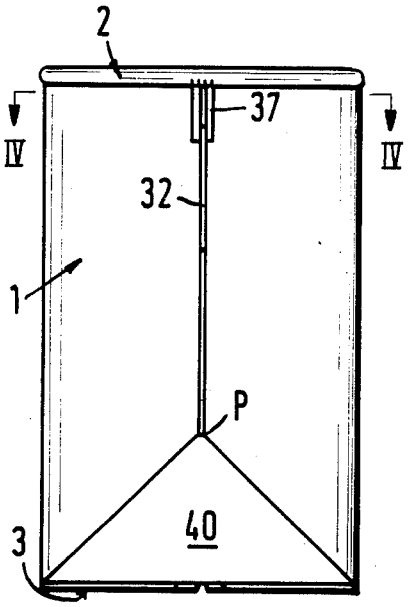

FLUID PACK WITH HANDLE

BACKGROUND OF THE INVENTION

The present invention relates to a pack for containing materials which are capable of flow, comprising a tube which is formed by at least one longitudinal sealing seam. At the ends of the tube are disposed a bottom and a cover. The cover comprises thermoplastic material without a carrier material, is injected on the tube, and has a pouring means. The tube comprises carrier material, for example cardboard, which is coated at least on one side with thermoplastic material. The pack bottom is quadrangular and is formed from the folded-over tube of the pack in the form of a fold-type closure and has a transverse sealing seam with triangular flaps which are folded over onto an adjacent wall. The cover and the cross-section of the pack, at least in the region of the cover, are round.

A pack of this nature is already known from European patent application, Publication No. 052261. Although such a pack can be produced by means of simple tools and has advantages in that it enjoys good stability, makes good use of the space occupied and is properly fluid-tight, the final consumer has to grip the pack on the outside walls of the tube, in order to carry the pack or to pour its contents.

SUMMARY OF THE INVENTION

One principal object of the present invention is therefore to provide a pack of the kind set forth above, but which has a handle so that the final consumer enjoys better handling and transportability. However, essential features and advantages of the known pack should not be lost, including the manufacture thereof from a web of cardboard which is in a flat condition, a low level of material consumption, and the like.

According to the invention, that object is attained in that a portion of the tube wall, which adjoins the periphery of the cover, is folded onto itself, forming a handle, and is joined to provide a double-wall surface portion in which a gripping opening is provided. The cover, which is injected onto the tube, is extended over the upper edge of the double-wall surface portion with the gripping opening to provide a stiffening web.

By virtue of these features, the manufacture of the fluid pack can use a web which is in a flat condition, for example a web of cardboard of paper, and can attain the same advantages as the known pack with good stackability and reclosability by virtue of a suitable configuration of the cover which only comprises thermoplastic material. At the same time, improved handleability is provided with a stiff handle which is fixed and firmly tied into the pack. The handle is tied into the pack by virtue of a stiffening web portion which extends over the double-wall surface portion with the gripping opening. In other words, in accordance with the invention, the surprisingly simple provision of the handle surface portion, i. e., the double-wall surface portion with the grippinq opening, is effected in that fold lines are so incorporated and established in the web, which is initially in a flat condition, that the material of the tube provides two surface portions which, projecting out from the tube, are folded onto themselves and joined together.

In that connection, in accordance with the invention, it is particularly desirable if the double-wall surface portion with the gripping opening is of a triangular configuration such that the upper edge thereof forms a short one of the two sides adjoining the triangle hypotenuse, its outer fold edge which extends substantially in the longitudinal direction of the tube forms a long one of said two sides, and the two inner fold edges which lie one upon the other form the hypotenuse. The above-mentioned surface portion is most desirably of a triangular configuration, with each half of the double-wall surface portion being triangular in the above-described manner. Accordingly, the blank therefore has two such triangular sides which are disposed directly one upon the other, in a mirror-image relationship, being joined together by way of a fold line. Such a surface portion can be advantageously arranged within the web of material which is to form the tube of the pack, and can be folded out by per se known manufacturing and folding machines. In that way, it is possible to provide a means for gripping or handling the pack or a means for transporting the same, which the final consumer can use easily and reasonably and therefore without difficulties.

In further accordance with the invention, the double-wall handle surface portion with the gripping opening may be fixedly and firmly joined to the body of the pack in a particularly advantageous manner, if the stiffening web is provided with a plurality of ribs. These ribs extend as far as the gripping opening, which is disposed at a spacing from the upper edge of the double-wall surface portion. The stiffening web is preferably additionally provided with a stiffening bead which covers over at least an edge portion of the gripping opeing. By virtue of the double-wall handle portion being secured along the hypotenuse, that arrangement already provides a strong holding and stiffening force, while the above-described ribs and the stiffening bead afford a handle which is very robust in terms of the service life of the pack.

Another advantageous embodiment of the invention provides three side walls of the tube that extend, as viewed in its longitudinal direction, substantially perpendicular to the square bottom. A fourth side wall with the handle, a viewed from the side transversely onto the double-wall handle portion, extends inclinedly with respect to the longitudinal direction. Packs of the kind described herein are frequently gathered together and transported in collective containers, in particular from the manufacturer to retailers. The above-described features provide for good stackability within the collective container, while taking up a small amount of space, even though a handle is disposed on each pack on one side thereof.

In this regard, it has been found to be particularly advantageous if, in accordance with the invention, the length of the upper edge of the double-wall gripping surface portion, said upper edge representing the short one of the two sides adjoining the hypotenuse of the triangular configuration, is substantially equal to the radius of the round cover. Such a configuration has been found to be very durable and the final consumer can then move the pack in a particularly advantageous manner which emptying and handling it.

An interesting aspect of the invention relates to the question of the volume of the pack. Since the handle is in fact formed from the material of the walls of the tube in one piece therewith, such formation should not cause too much of the volume of the pack to be lost. For this purpose, it has been found to be particularly advantageous if, in accordance with the invention, the lower corner point of the triangular handle surface portion, i. e., the point of intersection of the hypotenuse and the long one of the two adjoining sides of the triangular configuration, is disposed at a spacing from the bottom edge which is in the range substantially between zero and one-third of the height of the pack. In this way, the region of the material of the tube which is required for the handle or gripping portion can be kept as small as possible and the dead zones which are formed by virtue of the provision of the double-wall gripping surface portion are minimized. In other words, this arrangement makes it possible to restrict to a minimum the deal volume required for the gripping surface portion.

Another advantageous embodiment is characterized in that an elongate plastic cover strip is sealed on the inside of the tube along at least a part of the interconnected inner fold edges of the handle surface portion. Thus, on the one hand, the strength of the double-wall handle surface portion is improved by virtue of the fact that, for example, the pressure of the contents of the pack does not cause one wall of the triangular configuration to come away from the other. On the other hand, such an arrangement also ensures that fluid cannot collect between the two triangular surfaces when small improper passages occur.

As an alternative, it is also possible, in accordance with the invention, to provide a respective plastic cover strip sealed on the inside of the tube along at least a part of the height of each of the inner fold edges forming the handle surface portion. The fact that the additional plastic cover strip is sealed in position results in the presence of an additional amount of plastic material in the area in question so that the sealing effect is particularly strong in that area and the arrangement ensures that a filled pack cannot split open as a result of the two triangulr walls forming the handle surface portion being pulled apart.

When producing such a pack with a handle, the surfaces of the cover and the bottom should be disposed in parallel relationship to each other, particularly when the bottom is square or rectangular. If such a pack is to be produced from a continuous web, the tube blank must substantially be produced from that web. One skilled in the art will readily appreciate that, when providing a handle on a round tube, outer edges occur in the blank which are not a clear straight line in the direction of the web. Therefore, the invention provides that the two mutually oppositely disposed end edges of the blank, which are respectively disposed at the cover and the bottom, have transitional regions of a complementarily bent configuration between the middle and outer regions of the blank. If in fact a blank which has been separated from the web is folded into the final form, forming the handle, it will be immediately seen that a curved or bent transitional region must be provided in particular at those locations at which the above-mentioned upper edge of the double-wall surface portion (the short one of the two sides adjoining the hypotenuse of the triangular configuration) goes into the upper edge of the round tube, so that in side view the upper edge of the tube forms a straight line, in the finished condition, with the upper edge of the double-wall surface portion.

As will be explained in detail in reference to the preferred embodiment, the transitional regions lateral of the triangular surface portions of the web are bent out on the side toward the upper edge of the double-wall surface portion. As a result, on the opposite side, i.e., at the other end of the blank, it is necessary to provide a correspondingly rounded transitional region by drawing in toward the middle of the blank. This is achieved by forming the material for the transverse sealing seam, in the block bottom region, of such a width that sufficient sealing area remains, even with the cut-out portion.

A further desirable feature of the invention provides that the longitudinal sealing seam forming the tube is formed by joining oppositely disposed inward sides, extending one side beyond the other, and folding over the projecting edge, with adhesion thereof on the outside of the tube. Although there is the known option of forming such a longitudinal sealing seam with an outer edge of the tube being sealed onto the inner edge, in which case the sealing seam can be referred to as an "overlap" seam, such an arrangement means that a cut edge is exposed towards the inside of the tube. Fluid can then penetrate into the cut edge and into the open and unprotected carrier material (paper or cardboard) and cause it to swell. This known phenomenon can be avoided by sealing a protective strip (edge protection) in position. However, such an arrangement is made unnecessary by use of the features as described above.

The foregoing demonstrates that the invention makes it possible for the first time to form a pack of a known type from a continuous web of material, even though the pack has a handle whose material is taken directly from the web itself and is provided in such a way that it can be folded out, by virtue of suitable fold lines. The handle occupies a small dead volume, and is fixedly disposed on the tube with a configuration that provides good stackability within collective containers. The apex of the triangular handle surface portion is generally disposed in the lower region of the pack and in the extreme case may even be disposed at the lower edge of the bottom. In this regard, the spacing of the apex from the lower edge of the bottom of the pack is about one-quarter or one-fifth of the height of the pack, as measured between the surfaces of the cover and the bottom of the pack when assembled.

In this manner, it is possible to provide a pack for containing or holding, for example, two liters of fluid, preferably milk. The raw material of the pack is a web in a flat condition comprising a plastic-coated carrier material. The final condition of the pack is the above-described cylindrical tube, with a handle mounted thereto in a manner that takes into consideration consumer habits, in that the pack can be readily opened, reclosed and handled for pouring.

A further preferred embodiment, in accordance with the present invention, is characterized in that the longitudinal sealing seam for the tube is disposed in the edge region of the handle surface portion, which is perpendicular to the cover. Although the handle surface portion comes to lie in the middle region thereof, the preferred embodiment provides that a respective layer or ply of the double-ply handle surface portion occurs at the edge of the blank. At one side, also at the edge of the blank, is the longitudinal sealing seam which is directly connected by way of a fold line to the one layer or ply of the adjacent handle surface portion.

This embodiment enjoys a number of advantages. Since each seam, including the longitudinal sealing seam of the tube, represents a weak point in a fluid pack, it is particularly advantageous if the region of the longitudinal sealing seam which occurs at the handle surface portion is taken out of contact with the fluid, which is the case for the above-indicated blank. Thus, in the preferred embodiment, the longitudinal sealing seam is kept out of the contact with the fluid over more than two-thirds of the height of the pack. Another advantage is the additional stiffness in the handle which, as will be appreciated, is considerably strengthened by the formation of the longitudinal sealing seam. A further advantage which should not be overlooked is that the arrangement of the layers or plies of the handle surface portion, in the edge regions of the blank, causes the middle region to remain in one piece and smooth. This gives a better display surface, specifically a large area which extends from one layer or ply of the handle surface portion to the other, in one piece without any interruption by a seam or other intersection. This display surface is typically used for carrying printing, as is already known to the consumer in relation to generally similar packs. In carrying out such printing, it is desirable to eliminate any displacement of the overall image, for example due to its being divided by an intersection of portions of the pack. This result is achieved in a particularly advantageous manner with this second preferred embodiment.

Further advantages, features and possible uses of the present invention will be apparent from the following description, the acompanying drawings, and the appended claims.

BRIEF DESCRIPTION OF THE DRAWINGS

FIG. 1 is a perspective view of a preferred embodiment of the pack with handle, which projects toward the rear and is partly hidden;

FIG. 2 is a side view of the pack shown in FIG. 1, showing the handle laterally, the pouring means being pressed inwardly within the external contour of the pack so that it cannot be seen;

FIG. 3 is a rear view of the pack shown in FIG. 1, shown generally along the line III—III of FIG. 2;

DETAILED DESCRIPTION OF THE PREFFERED EMBODIMENTS

Figure 11:
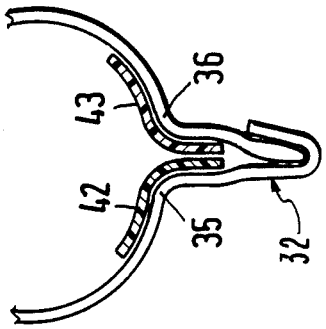
FIG. 11 is a view similar to FIG. 5, but with different arrangements for the longitudinal sealing seam in accordance with a second embodiment.

The finished pack for materials which are capable of flow, in accordance with the present invention is illustrated in FIGS. 1 to 3. The pack comprises side walls generally denoted by reference numeral 1. In this embodiment, the pack has a round cross-section in the region of the cover 2 (because the cover 2 which covers the open tube at the top is also generally of a circular configuration). As a result, it is only possible to distinguish between four side walls on the end of the tube having the end wall forming the botom 3. For the sake of simplicity, however, reference will only be made herein to side walls 1.

Figure 9:
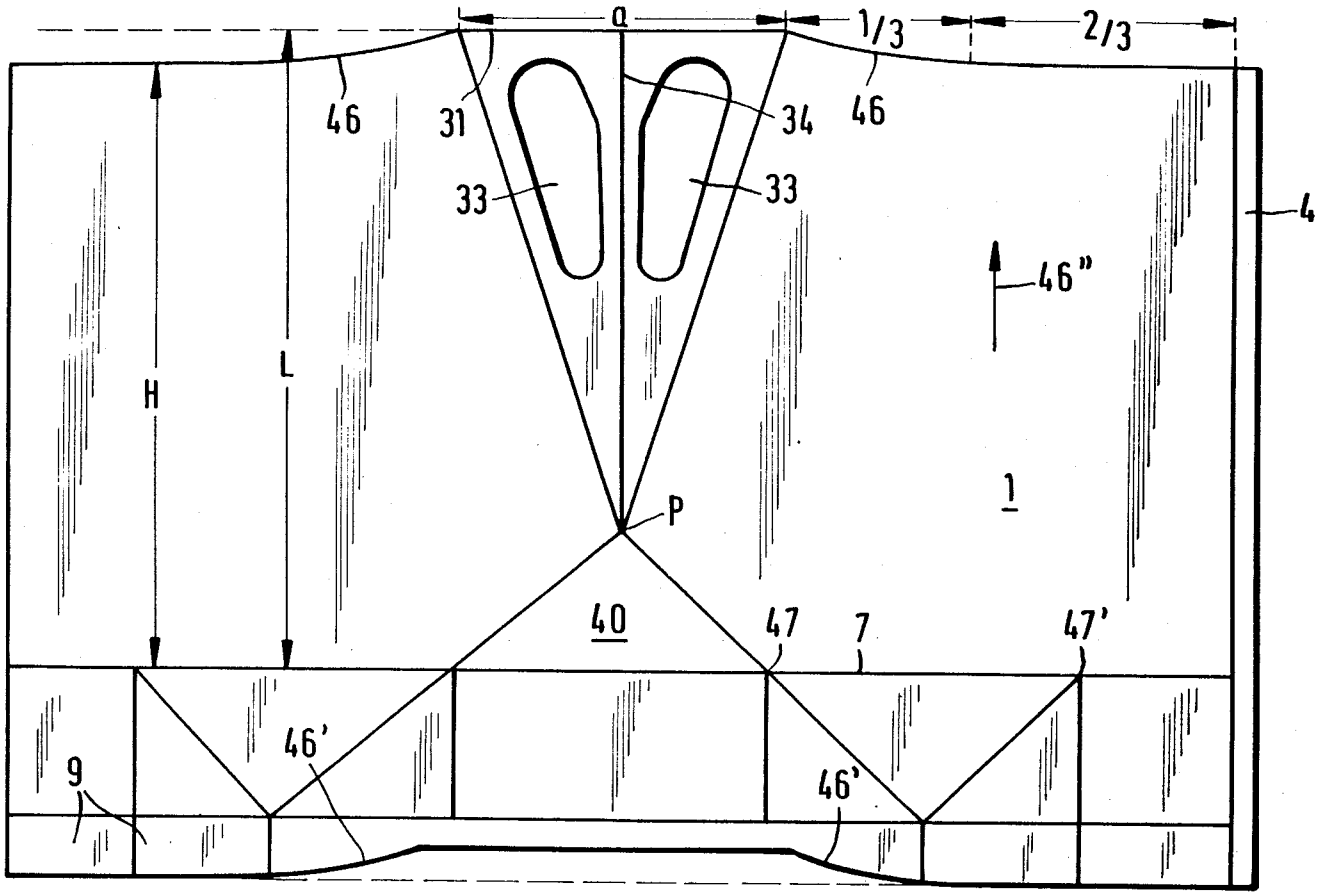
FIG. 9 is a plan view showing a blank for the pack in a first embodiment prior to formation of the pack.

As shown in FIGS. 1–3, the side walls are formed into a tube and are joined together for definitively forming the closed tube along the longitudinal sealing seam 4 which is omitted from the views shown in FIGS. 2–5. Those skilled in the art will be aware that the longitudinal sealing seam 4 extends into the bottom 3. This can be seen from the blank shown in FIG. 9, the block bottom of which is typical and does not need to be described in greater detail herein. The pack, i.e., the tube after the block bottom 3 has been folded together, is of a height H which, again having regard to the blank shown in FIG. 9, is somewhat less than the length L of the portion of material, as will be described.

The operation for folding the block bottom generally indicated by reference numeral 3, will not be described in greater detail herein. Some information concerning fold lines for the bottom may be seen from the blank shown in FIG. 9.

Referring again to FIG. 1, cover 2 is formed from thermoplastic material without a carrier material, and is injected on the tube 1, specifically at a circular upper edge which is not shown herein. The cover 2 is injected in a configuration for use, as shown in FIG. 1. In contrast, the configuration shown in FIGS. 2 and 3 is a form for transportation, in which the pouring means generally denoted by reference numeral 13, is folded inwardly of the external contour of the pack in such a way that there are no individual parts of the pouring means 13 projecting beyond the upper edge 6. This ensures that the pack has satisfactory stability when standing and can be satisfactorily wrapped (by means of shrink films or the like).

As shown in FIG. 1, the pouring means 13 is carried centrally on the cover 2 in the form of an annular collar 14 which stands in an outward direction, shown upwardly in FIG. 1. The upper edge 15 of the collar 14 is connected to a closure plug or stopper 16 with a gripping ring 17 welded thereto. The point of connection is indicated by reference numeral 23. The hinge for the stopper 16 is not shown in greater detail, since the provision of such a pouring means 13 is known per se and further is not important in regard to describing the present invention.

A significant aspect of cover 2, in accordance with the invention, is a stiffening web 30 which is particularly clearly shown in FIGS. 1 and 2 and which is injected in one piece with the cover 2 over the upper edge 31 of a double-wall handle surface portion 32 with a gripping opening 33 provided therein. In this manner, the cover 2 which is injected at the top onto the edge of the tube is extended radially toward one side, in the form of a web portion (stiffening web 30) which is injected onto the upper edge 31 of the handle surface portion 32.

The handle surface portion or double-wall surface portion 32 comprises a plastic-coated carrier material, for example cardboard. Portion 32 joins the tube wall 1, and is formed from the same blank in such a way that, upon suitable folding of the blank, a handle can be formed by virtue of two parts of the tube wall. In the present case, these parts are preferably of a triangular configuration, being folded onto themselves, thereby forming the above-mentioned double-wall triangular surface portion 32.

Referring now to FIG. 3, the double-wall handle surface portion 32 will be seen in the form of a narrow double line, since viewed from the rear, the handle surface portion is only as thick as two layers of cardboard applied one upon the other.

The form and arrangement of the handle surface portion 32 is best shown in FIG. 2. Upper edge 31 forms a short one of two sides adjoining the hypotenuse of the triangle, defined by portion 32, while the outer fold edge 34 which extends substantially in the longitudinal direction of the tube (in the longitudinal direction of the sealing seam 4 shown in FIG. 1) forms the longer of the two sides. The two inner fold edges 35 and 36 which lie one upon the other form the hypotenuse.

It will also be seen that the stiffening web 30 is provided with ribs 37 which are formed on the web 30 and which can be injected at the same time in the injection molding operation. Ribs 37 extend from the stiffening web 30 downwardly in the direction of the longitudinal axis of the tube 1 approximately as far as the gripping opening 33 which is disposed at a spacing from the upper edge 31 of the double-wall surface portion 32. Ribs 37 terminate at the edge or end of the gripping opening 33 which is towards the stiffening web 30. At such end of the gripping opening 33, a stiffening bead 38 extends over the edge of the opening 33, joining the two free ends of the ribs 37 together. In this way, the overall structure of the gripping surface portion 32 with stiffening web 30 enjoys considerable strength and stiffness.

As illustrated in FIG. 1, it will be seen that the three front side walls, namely the side wall with longitudinal sealing seam 4 and the two adjoining side walls separated by the partial fold edges 39, extend substantially perpendicular relative to the bottom 3, as can also be seen from FIGS. 2 and 3. In contrast, FIG. 2 clearly shows that the fourth side wall which is disposed opposite the longitudinal sealing seam 4, namely the wall having the handle defined by portion 32, extends at an angle to the longitudinal direction. In the embodiment illustrated herein, the fourth side wall in turn comprises three parts, as best shown in FIG. 3. The lower triangular part 40 adjoins the pack bottom 3 and the remaining two parts of the fourth side wall in turn adjoin the lower part 40. These two parts are separated by the double-wall handle surface portion 32 and merge into the tube wall 1 or form parts thereof.

Various considerations and tests were made in selecting the dimensions of the pack, and it has been found to be particularly desirable for the length of the upper edge 31 of the double-wall handle surface portion 32 (the upper edge forming the short side of the triangular configuration) to be approximately equal to the radius of the circular portion of the cover 2.

Referring to FIGS. 2 and 3, a corner point P is shown, the position of which relative to the cover 2 and the bottom 3 is significant with regard to stackability, strength and utilization of volume. In the embodiment illustrated herein, this lower corner point, which is the point of intersection of the longer of the two sides of the triangular configuration, with the hypotenuse, is located at some spacing from the bottom 3. This spacing should not exceed about one-third of the height H of the pack, and may be as little as zero, in which case the point P is located within the plane of the bottom 3. In such event, the triangular surface portion 40 shown in FIG. 3 is, of course, no longer present.

Figure 5:
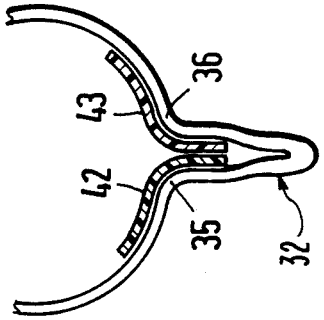
FIG. 5 is a partial view similar to FIG. 4, with the upper half of the tube broken away, showing an alternative embodiment in which a separate cover strip is applied on the inside of the tube over each inner edge.
Figure 4:
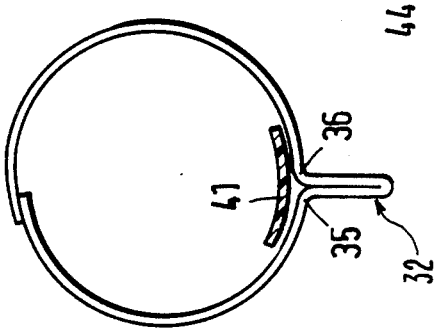
FIG. 4 is a diagrammatic cross-sectional view through the upper region of the pack with the handle surface portion taken generally along the line IV—IV of FIG. 3, showing the arrangement of the elongate plastic cover strip.

FIGS. 4 and 5 show two alternate embodiments for the pack wherein one or two plastic cover strips 41, or 42 and 43, respectively, are sealed lengthwise on the inner fold edge 35 or 36 respectively of the handle surface portion 32. Each strip serves to hold together the two triangular halves of the handle surface portion 32, while also preventing fluid from penetrating into any space which may occur within the double-wall handle surface portion 32 in the region of the strips 41 or 42 and 43. While in FIG. 4 a single cover strip 41 is sealed into position along the two inner fold edges 35 and 36 which are disposed in directly juxtaposed relationship, overlapping both those edges at the same time, the embodiment shown in FIG. 5 illustrates that a separate strip 42 or 43 may be previously sealed in position on the blank along each of the inner fold edges 35 and 36 respectively.

It can be seen from FIG. 2 that the two inner fold edges 35 and 36 which bear one against the other extend from the point P to cover 2; in other words, these edges are of a length corresponding to the triangle hypotenuse. The plasic cover strips 41–43 must cover at least a part of the handle region. However, it is generally sufficient if the length of the cover strip 41 or 42, 43 extends over only one-third or one-half of the length between P and the cover 2.

Figure 8:
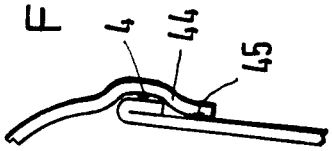
FIG. 8 is a cross-sectional view similar to FIG. 7, but after the longitudinal sealing seam has been laid over and the longer part has been caused to adhere with its inside surface to the outside surface of the oppositely disposed wall portion.
Figure 7:
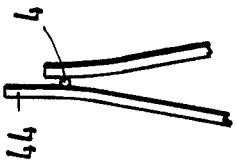
FIG. 7 is a view on an enlarged scale of the upper portion of FIG. 6, with the longitudinal sealing seam more clearly shown in exaggerated form.
Figure 6:
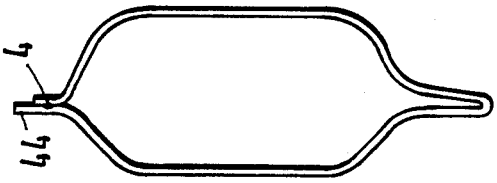
FIG. 6 is a diagrammatic cross-section view of a still unfinished tube in which the longitudinal sealing seam is formed by joining mutually oppositely disposed inward sides.

FIGS. 6 and 7 diagrammatically show the manner in which the longitudinal sealing seam 4 can be formed by the two mutually opposite disposed inward sides of the web material for sealing the tube together. If the strip 44 which extends outwardly in FIGS. 6 and 7 is folded over in a manner shown in FIG. 8 in such a way that the inward side of the left-hand wall portion, with the strip 44, comes to lie upon the outside of the oppositely disposed wall portion, as shown in FIG. 8, and is sealed thereto as indicated at 45, there is no longer any need for the otherwise conventional edge protection means for the longitudinal sealing seams 4 which are prouced in an overlapping configuration.

FIG. 9 shows a blank for forming the tube of a pack illustrated in FIG. 1, the direction of movement of the web of carrier material being indicated by the arrow 46". At its center and symmetrically on both sides of fold line 34, the front or leading edge of the blank comprises a straight portion of a length A, which is equal to double the length of the upper edge 31 (or, equal to double the length of the short side of the triangular configuration). It is assumed in this case that the longitudinal sealing seam 4 is provided at the side edges.

One important factor is the position of the point P with respect to the fold edge 7 which represents the boundary line between the block bottom 3 and the remainder of the surface forming the side walls 1 of the tube. While the spacing of the upper edges 31 from the bottom fold line 7 is L, the height of the completed pack is only H. If, for example, the height H of the pack is 23 cm, the difference between L and H is 10 mm. Expressed in general terms, this different L−H is approximately equal to one tenth of the diameter of the end of the tube at the cover 2 when the pack is upright, at its upper end.

The difference in lengths L and H along the leading and trailing edges of the web does not have an abrupt transition at edge 31, but rather has rounded transitional regions identified by reference numeral 46. It will be seen from FIG. 9 that each transitional region 46 makes up about one-third of the half of the tube periphery on each side. In this regard, the three-thirds shown at top right in FIG. 9 make up a distance equal to one-half of the periphery of the tube (the material for the longitudinal sealing seam 4 is disregarded).

While the leading edge is shown at the top in FIG. 9, the rearward or trailing edge appears at the bottom. It will be appreciated that these mutually oppositely disposed end edges of the blank must have transitional regions of a complementarily bent or curved configuration, for which reason the transitional regions at the trailing end edge are identified by reference numeral 46'. The width of this transverse sealing seam 9 is sufficently wide that sufficient material for a good sealing seam remains in the middle region of the handle surfae portion 32 or the triangular surface portion 40 in FIG. 9.

If, in a particular situation, the point P is located along the fold edge 7, that is, if the spacing of the point P from the bottom edge 7 is made zero, then the point P should also occur in a corner of the block bottom which is indicated, for example, in FIG. 9 at 47 or 47'.

Figure 10:
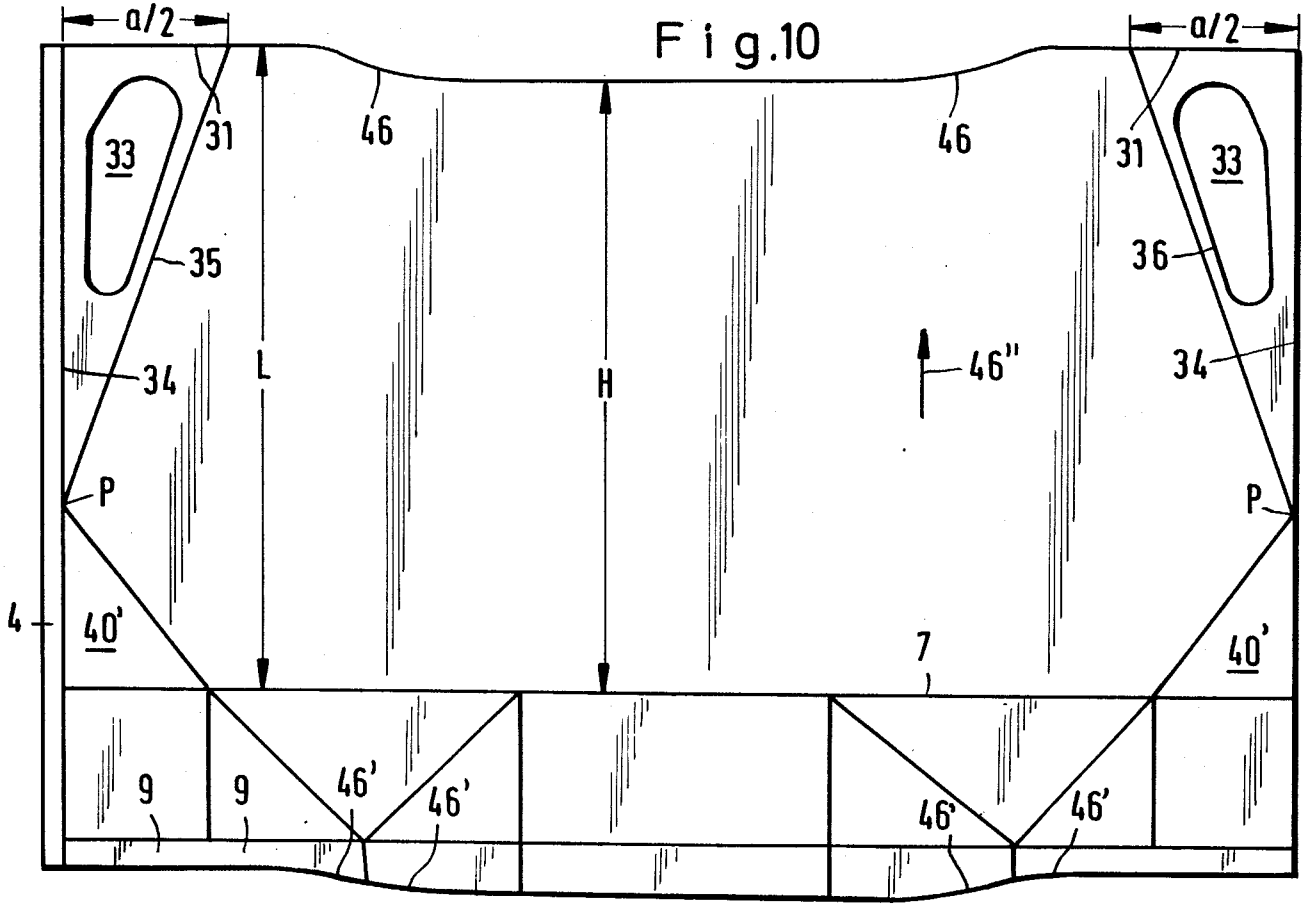
FIG. 10 is a plan view similar to FIG. 9, showing a blank of the pack in a second embodiment.

Another blank for a second embodiment is shown in FIG. 10 in which the same components are denoted by the same reference numerals as in FIG. 9. For that reason, there is no need to describe again in detail aspects which are the same. In this embodiment, the fold line 34 is moved outwardly and coincides with the fold line by way of which the longitudinal sealing seam 4 and is joined to the other material of the blank. Therefore, the point P also occurs at the edge of the longitudinal sealing seam 4, which is shown at the left-hand edge in FIG. 10. Fold line 34 and seam 4 extend in the direction of movement 46'' of the web of material. The upper edge 31 is moved to the side edges, as are the respective individual layers or plies of the handle surface portion 32 in which the gripping opening 33 is disposed. The length of each upper edge 31 is therefore A/2.

The transitional regions 46 along the leading edge (at the top viewed in the direction of movement of the blank as illustated in FIG. 10) are also further moved toward the side edges in this second embodiment. The same also applies in regard to the rearward or trailing transitional regions 46' by virtue of which the transverse sealing seam 9 is wider in the middle and thinner at the outsides, being therefore precisely the opposite to the embodiment of FIG. 9.

In the embodiment shown in FIG. 10, the longitudinal sealing seam 4 no longer comes into contact with the fluid above the point P, that is to say, over a region of more than two-thirds of the height H of the pack, so that the risk of the pack leaking is considerably reduced. Although the two layers or plies of the handle surface portion 32, which are arranged on the outside on the right-hand and left-hand sides in the embodiment in FIG. 10 are glued together for the purposes of assembling and finishing the pack, the fact that the longitudinal sealing seam 4 is folded over at the fold line 34 gives an additional and considerable degree of stiffness. In contrast, the middle region still has a smooth continuous surface for printing to be applied thereto. The printing need not be detrimentally affected by displacement to avoid sealing seam 4 as could possibly occur with the pack shown in FIG. 1.

Finally, FIG. 11 showns the same sectional view as that illustrated in FIG. 5, but showing the alternative arrangement for the longitudinal sealing seam, resulting from use of the blank of FIG. 10. While the two layers or plies of the handle surface portion 32 are only joined by the fold line 34 in FIG. 5, the embodiment shown in FIG. 11 involves a welded connection by way of the longitudinal sealing seam 4 itself.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. In a pack for containing materials capable of flow, including:

a tube formed from a flat carrier material blank having a coating on at least one side thereof, said blank joined along a longitudinal side sealing seam to form said tube, said tube having a side wall;

a quadrangular bottom formed from said blank by folding one end of said tube to close said tube and including at least one bottom sealing seam;

a cover formed from a thermoplastic material and attached to an end of said tube opposite said bottom, said cover and the cross-section of a portion of said tube in the vicinity of said cover being generally rounded; and means formed in said cover for pouring contents from the pack;

the improvement comprising:

a portion of said tube side wall adjacent said cover being folded onto itself along an outer fold line and joined to define a double-walled portion connected to said side wall;

said double-walled portion having a gripping opening defined therethrough, whereby said double-walled portion and said gripping opening define a handle for said pack; and said cover being formed to extend over and being attached to said double-walled portion along the entire length of an upper edge thereof to provide a stiffening web;

said gripping opening being disposed at a spacing from said upper edge;

a plurality of stiffening ribs connected to said stiffening web and extending downwardly therefrom disposed against said double-walled portion to said gripping opening;

said tube defining four side walls extending partially upward along said tube from said bottom, three of said walls extending substantially perpendicular with respect to said bottom, and the fourth of said walls extending inclinedly outwardly with respect to said bottom and terminating at the lowermost portion of said handle; and said blank defining mutually opposed top and bottom edges, said top edge being positioned adjacent said cover and said bottom edge being positioned along said bottom following assembly of said blank into said pack, each of said top and bottom edges defining a pair of symmetrically disposed outer portions therealong and an intermediate middle portion, said middle portion being connected to each of said outer portions by an arcuate transitional region along said top or said bottom edge.

2. A pack as defined in claim 1, wherein said double-walled portion is formed to define a right triangle wherein said upper edge of said double-walled portion defines a short side of said triangle, said outer fold line defines a long side of said triangle, and the junction between said double-walled portion and said tube defines a hypotenuse of said triangle.

3. A pack as defined in claim 3, further comprising a stiffening bead connected to said ribs and extending over at least an edge portion of said gripping opening.

4. A pack as defined in claim 1, wherein said cover, with the exception of said stiffening web, is generally circular having a radius, and wherein said upper edge of said double-walled portion is substantially equal to said radius.

5. A pack as defined in claim 2, wherein said long side and said hypotenuse of said triangle define at their intersection a lower point disposed along said tube side wall, and wherein said lower point is further disposed along said tube side wall at a spacing from said bottom substantially within the range of from zero to one-third of the distance between said bottom and said cover.

6. A pack as defined in claim 1, wherein said tube defines an inner surface, and further comprising an elongate cover strip sealed to said inner surface to cover at least a portion of the junction between said double-walled portion and said tube.

7. A pack as defined in claim 1, wherein said tube defines an inner surface, and wherein the junction between said double-walled portion and said tube is defined by a pair of handle fold lines formed into said tube, further comprising a pair of elongate cover strips, each of said strips sealed to said inner surface to cover one of said handle fold lines.

8. A pack as defined in claim 1, wherein said blank defines mutually opposed side edges, and wherein said longitudinal side sealing seam for joining said blank to form said tube is formed by joining said side edges whereby one of said edges is extended beyond the other to define a projecting edge, said projecting edge being folded backwardly, and having an adhesive applied to the outer surface of said tube.

9. A pack as defined in claim 1, wherein said longitudinal side sealing seam is disposed perpendicular to said cover along said outer fold line of said doublewalled portion.

* * * * *